US005835524A

United States Patent [19]

Berger et al.

[11] Patent Number: 5,835,524

[45] Date of Patent: Nov. 10, 1998

[54] SCRAP-MELTING ELECTRIC ARC FURNACE

[75] Inventors: Harald Berger; Peter Mittag, both of Linz; Heinrich Auberger, Walding; Peter Wimmer, Wels; Johann Auer, Florian; Alfred Weber, Luftenberg; Johannes Steins, Gallneukirchen, all of Austria

[73] Assignee: Voest-Alpine Industrienlagenbau GmbH, Linz, Austria

[21] Appl. No.: 605,011

[22] PCT Filed: Mar. 30, 1995

[86] PCT No.: PCT/AT95/00064

§ 371 Date: Feb. 28, 1996

§ 102(e) Date: Feb. 28, 1996

[87] PCT Pub. No.: WO96/00877

PCT Pub. Date: Jan. 11, 1996

[30] Foreign Application Priority Data

Jun. 28, 1994 [AT] Austria ..... A-1270/94

[51] Int. Cl.[6] ..... F27D 3/00

[52] U.S. Cl. ..... 373/79; 373/80; 373/52; 373/100

[58] Field of Search ..... 373/71, 72, 73, 373/79, 80, 81, 84, 94, 100, 52, 53, 3

[56] References Cited

U.S. PATENT DOCUMENTS

| | | | |
|---|---|---|---|
| 910,581 | 1/1909 | Reid | 373/3 |
| 1,108,924 | 9/1914 | Moffat | 373/80 |
| 1,421,185 | 6/1922 | Driscoll | 373/79 |
| 1,430,948 | 10/1922 | Counas | 373/72 |
| 1,987,952 | 1/1935 | Wilson | 373/79 |
| 2,382,534 | 8/1945 | Baily . | |
| 4,214,736 | 7/1980 | Wolf . | |
| 5,535,235 | 7/1996 | Ao et al. | 373/78 |

FOREIGN PATENT DOCUMENTS

| | | |
|---|---|---|
| 0548041 | 6/1993 | European Pat. Off. . |
| 2218397 | 9/1974 | France . |
| 2611876 | 9/1988 | France . |
| 2627578 | 8/1989 | France . |
| 2715697 | 10/1978 | Germany . |
| 2944269 | 11/1979 | Germany . |
| 3241987 | 11/1982 | Germany . |
| 3609923 | 3/1986 | Germany . |
| 9313228 | 7/1993 | WIPO . |
| 9424506 | 10/1994 | WIPO . |

*Primary Examiner*—Tu B. Hoang
*Attorney, Agent, or Firm*—Ostrolenk, Faber, Gerb & Soffen, LLP

[57] ABSTRACT

A scrap-melting electric arc furnace operating at an elevated melting power having a simple construction that also avoids thermal loads of the side wall caused by the electrodes. The electrodes are protected from damage during scrap-charging. The electric arc furnace includes a bottom for receiving a melt. An upper part rises from the bottom part and has side walls. A lid covers the upper part. A charging shaft is disposed approximately centrically relative to the upper part, and has a diameter that is substantially smaller than the diameter of the upper part. The charging shaft interior communicates with the furnace interior via an opening in the lid. Electrodes arranged approximately radially symmetrically are directed obliquely into the furnace interior and project toward the center of the electric arc furnace.

43 Claims, 8 Drawing Sheets

37
17
25
23
24'
26
24
36
38
34
31
40
39
15
45
33
13
20
1
32
α
35
3
8
9
2
4
6
7
12
5

1
3
15
16
17
19
25
30
31
32
33
39
40
41
42
44
61
62

FIG. 4
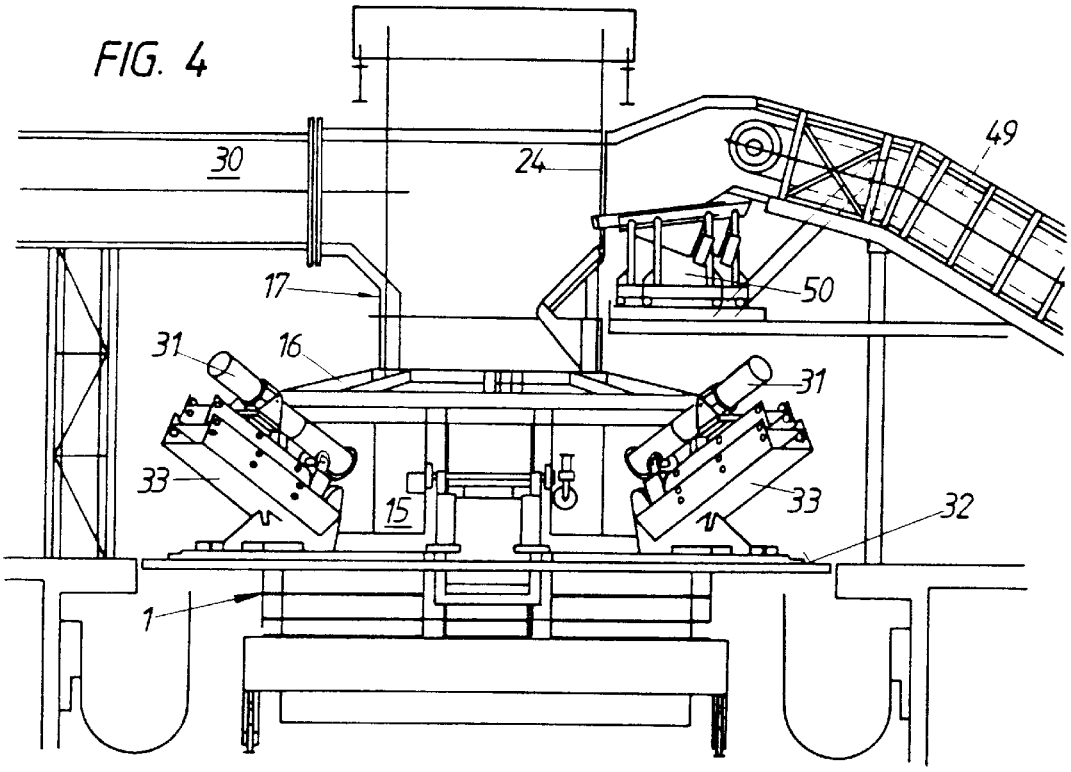
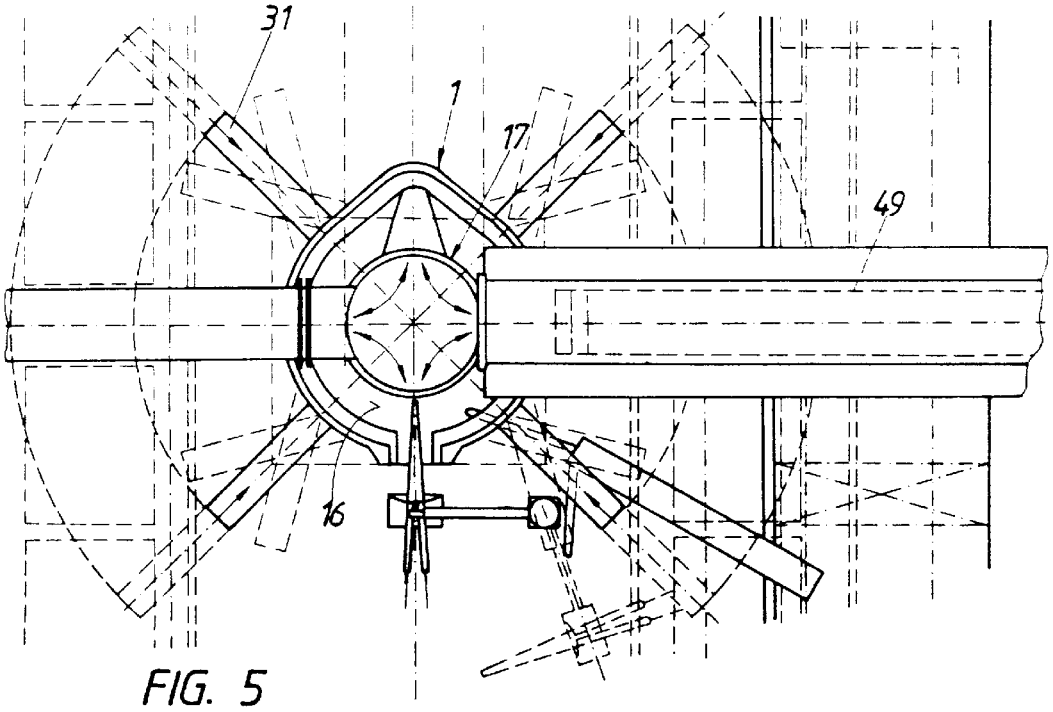
FIG. 5

25
53
52
17
54
56
55
31
16
31
44
58
57
20
57
32
33
1
10
8
6
3
2
7

SCRAP-MELTING ELECTRIC ARC FURNACE

This Application is a 371 of PCT/AT95/00064 filed on Mar. 30, 1995.

The invention relates to a scrap-melting electric arc furnace, particularly for melting ferrous scrap and, if desired, sponge iron for producing steel.

Conventional direct current scrap-melting electric arc furnaces comprise a single centrically located graphite electrode perpendicularly arranged in the furnace vessel. The maximum energy input feasible, which depends on the secondary current, is limited by the maximum diameter possible of the graphite electrode.

Moreover, the energy input via a single electric arc is concentrated on a site more or less in the center of the furnace and is affected by magnetic influences acting on the electric arc at high powers.

With conventional rotary current arc furnaces, such as, e.g., those according to DE-C-29 44 269, FR-B-2 218 397 and DE-A-32 41 987, a perpendicular crater is melted into the scrap by three electrodes arranged in the center on a partial circle and the remaining scrap is dissolved thereafter. The energy of the hot offgases rises through the empty crater unutilized, thus causing excessive heating of the lid and—as also happens with conventional direct current arc furnaces—a large glowing length of the electrode, which causes intensive lateral consumption of the same. Moreover, very sturdy electrode supporting arms and lifting beams with heavy guides are necessary for the electrodes in order to control the forces and vibrations also brought about by the high currents applied. Such means constitute an essential investment cost factor, rendering the conventional rotary current arc furnace more and more expensive and its operation cumbersome.

From EP-A-0 548 041 an electric arc furnace of the initially defined type is known, which renders it feasible to achieve a particularly high energy input at high operational safety and availability, in that the graphite electrode projects laterally into a lower part of the furnace vessel, with the lower part, in the region of the graphite electrode, having an enlargement radially protruding outwardly relative to the upper part. This radial enlargement has as its purpose to protect the graphite electrode against the falling down of the charging stock. Since the laterally penetrating graphite electrodes themselves are protected from the hot gases which are sucked off upwardly through the scrap column and thus heat the scrap, short glowing lengths of the electrodes as well as a correspondingly lower electrode consumption results.

The object of the present invention is to develop further an electric arc furnace of the last-described type so as to make it feasible, in spite of an elevated melting power, to utilize a furnace vessel having a simple—and thus easily producable—shape. Likewise it is to be feasible to utilize well-proven furnace vessels, namely conventional furnace vessels provided with an upper part having a perpendicular side wall. The thermal load on the side wall of the furnace vessel and the danger of damaging the electrodes during scrap-charging are to be minimized or altogether avoided.

In a scrap-melting electric arc furnace, this task is achieved by the combination of the following characteristic features:

a bottom part for receiving a melt, an upper part rising up from the bottom part and having a side wall oriented so as to be, at least in part, essentially parallel to the vertical center line of the electric arc furnace a lid which covers the upper part, a charging shaft disposed approximately centrically relative to the upper part and having a diameter which is considerably smaller than the diameter of the upper part, wherein the charging shaft interior communicates with the furnace interior via an opening provided at the lid and approximately radially symmetrically arranged electrodes are directed obliquely into the furnace interior and project roughly towards the center of the electric arc furnace.

From DE-C-36 09 923 an electric arc furnace is known, wherein several electrodes disposed on a partial circle are arranged close to the side wall of the upper part of the electric arc furnace and perpendicularly project into the furnace interior through the lid. The electric arc furnace is provided with a shaft mounted on the lid, in which the hot furnace gas heats scrap charged into the shaft. The electrodes are perforce disposed so as to surround the shaft peripherally. One disadvantage of this known electric arc furnace is the great thermal load on the side wall of the upper part of the electric arc furnace which is caused by the electrodes. If the electrodes are disposed closer to the furnace center, difficulties due to pieces of scrap falling down through the mounted shaft are to be anticipated.

From PCT application WO 93/13228 an electric arc furnace is known through the lid of which a charging shaft projects that tops the furnace vessel. The charging shaft is disposed eccentrically relative to the furnace vessel, which exhibits an elliptic ground plan. Further, electrodes project into the interior of the electric arc furnace through the lid, said electrodes also being disposed eccentrically relative to the furnace interior. Although it thereby becomes feasible to reduce the thermal load on the side wall of the furnace as compared to the electric arc furnace known from DE-C-36 09 923, it is still not feasible to melt the scrap charged in via the charging shaft directly by means of an electric arc, since the conical scrap pile does not extend to the electric arcs. Due to the elliptical shape of its ground plan, the furnace vessel is expensive in production.

According to the invention it is feasible, however, since the electrodes penetrate the side wall of the upper part and/or the lid of the furnace vessel, to produce a very flat electric arc in the furnace interior which impinges on the charged scrap directly. Electrode angles relative to the horizontal line may even be as small as 10°, so that it becomes feasible to melt the scrap from top to bottom by means of the electric arc. The side wall of the upper part of the electric arc furnace is not exposed to a direct heat load, as the electric arc radiates heat primarily in a direction perpendicular to the axis of the electric arc. These advantages are associated primarily with a charging shaft that is arranged at the lid of the upper part and is substantially smaller in diameter than the upper part itself; the reason being that it thereby becomes feasible to obtain a centrically located conical pile consisting of scrap in the furnace interior, which makes possible the oblique arrangement of the electrodes with the above-described small electrode angles relative to the horizontal line. As a consequence, the electric arc can be kept at an accordingly great distance from the side wall of the upper part of the furnace, whereby a damaging thermal load on the side wall is avoided.

If the electrodes penetrate the side wall of the furnace vessel, this results in a simple design of the furnace vessel, and in particular of the upper part projecting upward from the bottom part, since, here, it suffices to provide openings for guiding through the electrodes. An even simpler construction results if the electrodes penetrate the lid of the furnace vessel. Thus, according to the invention, the advantage of an electric arc furnace having a particularly simple construction is achieved, which enables a high constant energy input at low levels of electrode consumption (short glowing length of the electrode). At the same time, integrated preheating of the scrap pile in the furnace vessel is ensured by the melting gases rising upward from the bottom. A particular advantage of the invention that generally furnace vessels of simple construction may be employed which have proven their worth over several decades.

To adjust an optimal electrode angle, the electrodes advantageously are tiltable about a horizontal axis by means of electrode supporting devices, particularly over a range between 10° and 60°, preferably between 30° and 60°, relative to the horizontal line.

For simple handling of the electrodes, the electrodes are suitably supported by means of the electrode supporting device so as to be capable of displacement along their longitudinal axis.

To achieve great efficiency of the electrodes employed, they are suitably supported by means of the electrode supporting device so as to be pivotable about a vertical axis. Thereby it becomes feasible to ensure a wide range of influence of the electrodes while employing only a minimum number of them.

Advantageously, the charging shaft is rigidly connected with the lid of the electric arc furnace, particularly if the charging shaft is small in height. This is sufficient if production capacities are not extremely high. The charged scrap does not extend into the charging shaft but forms a pile which is shaped like a truncated cone and is strictly limited to the furnace interior, whereby it becomes feasible to apply the oblique electrode principle.

According to a preferred embodiment, the charging shaft is movable relative to the lid, wherein suitably the charging shaft is capable of lateral displacement, in a direction perpendicular to the longitudinal center line of the charging shaft or the upright electric arc furnace respectively. Consequently, even very large pieces of scrap can be charged to the furnace vessel in a simple manner. Additional advantages ensue with regard to maintenance and repair activities concerning the furnace, vessel—which becomes particularly easy to access - and the laterally displaced shaft.

In accordance with another preferred embodiment, between the lower end of the charging shaft and the opening provided at the lid of the electric arc furnace a sliding sleeve is provided which is capable of displacement along the longitudinal center line of the charging shaft or the electric arc furnace respectively, wherein suitably the lower end of the charging shaft is arranged at a distance above the lid of the electric arc furnace and the free space resulting between the lid and the charging shaft may be bridged over by means of the sliding sleeve.

Here it is particularly advantageous if the length of the sliding sleeve in the direction of the longitudinal center line of the charging shaft exceeds the height of the free space between the lid and the charging shaft, as this makes it feasible to form conical scrap piles of different dimensions in the furnace, interior, by positioning the lower edge of the sliding sleeve at a suitable level.

Thus the sliding sleeve renders it feasible to adjust the outline of the scrap crashing down the charging shaft and into the furnace interior when charging the first portions. The scrap crashing down the charging shaft and into the furnace interior during the charging of the first portions forms a conical pile having an angle of repose that corresponds to the specific physical composition of the scrap (size and type of the pieces of scrap). By lifting and lowering the sliding sleeve in the largest diameter of this conical pile, the latter can be adjusted to the desired measure, whereby it becomes feasible in any event to keep the scrap at the side wall below the region where the electrodes are conducted through the side wall.

Advantageously, the sliding sleeve is water-cooled and surrounds the charging shaft peripherally at its outside and is conducted along the outside of the charging shaft.

A preferred embodiment is characterized in that the charging shaft is provided with a charging opening which pierces its side wall and is closeable by means of a charging door, wherein suitably the charging door is displaceable horizontally or vertically from the closed position to an open position and vice versa and advantageously is water-cooled. Thereby it becomes feasible to carry out the charging without interrupting the melting process and without any perpendicularly ascending offgases emerging during the charging.

Advantageously, the charging opening at its lower edge is provided with a water-cooled rest for a charging means such as a scrap chute.

In order to accomplish a largely continuous charging of scrap, the charging shaft is suitably provided with a charging opening which pierces its side wall and where a conveying means, such as e.g., a conveyor belt, ends.

Another preferred embodiment is characterized in that, in addition, in one side wall of the charging shaft one further charging opening is provided that communicates with a delivery chute for charging cold or hot charging materials and/or fluxes. Thereby it becomes also feasible for example to charge hot sponge iron to the electric arc furnace, for which purpose the hot sponge iron can be delivered to the electric arc furnace in pear-shaped vessels inundated with nitrogen. In conventional electric arc furnaces fitted with perpendicular electrodes, difficulties due to the electrodes rising vertically upward and due to the electrode supporting frameworks would hardly be surmountable.

Suitably, the charging shaft is at its upper end connectable to an offgas duct.

In accordance with a preferred embodiment, the side wall of the charging shaft is provided with several nozzles for feeding an oxygen-containing gas, wherein advantageously a plurality of nozzles penetrate the side wall of the charging shaft and wherein the nozzles are arranged in the shape of a ring peripherally surrounding the side wall. The substantial amounts of CO gases, incurring in the electric arc furnace from the fusion and the subsequent refining—which form both as the oxygen reacts with the carbon contained in the charge as well as from organic components of the charge—thus can be afterburned in the electric arc furnace in such a manner that the resulting thermal energy serves for preheating the scrap while avoiding excessive oxidization of the scrap.

In accordance with another preferred embodiment, at least one lance supplying an oxygen-containing gas penetrates the wall or the lid of the furnace vessel.

Preferably, the electrodes project through the side wall of the upper part.

According to a preferred embodiment, an upwardly tapering wall section is provided between the charging shaft and the portion of the side wall of the electric arc furnace that is oriented essentially parallel to the vertical center line of the same and the electrodes project into the furnace interior through openings provided in this wall section, wherein suitably the upwardly tapering wall section is combined with the lid of the electric arc furnace.

In accordance with yet another preferred embodiment, the upwardly tapering wall section is combined with the side wall of the electric arc furnace.

A particularly simple construction wherein the full tiltability of the furnace vessel is ensured by only a slight displaceability of the sliding sleeve is characterized in that the sliding sleeve is arranged at the lid so as to be liftable and lowerable, wherein suitably the sliding sleeve is approximately equal in diameter to the lower end of the charging shaft and the sliding sleeve is arranged at the lid so as to be vertically adjustable by a maximum of 200 mm, preferably by 50 mm.

In the following the invention is disclosed in a more detailed manner with reference to several exemplary embodiments.

BRIEF DESCRIPTION OF THE DRAWINGS

FIG. 4 is a side view of a further embodiment of an electric arc furnace,

FIG. 5 illustrates the ground plan of the electric arc furnace shown in FIG. 4, but scaled down and in a very diagrammatic view.

DESCRIPTION OF THE INVENTION

Figure 1:
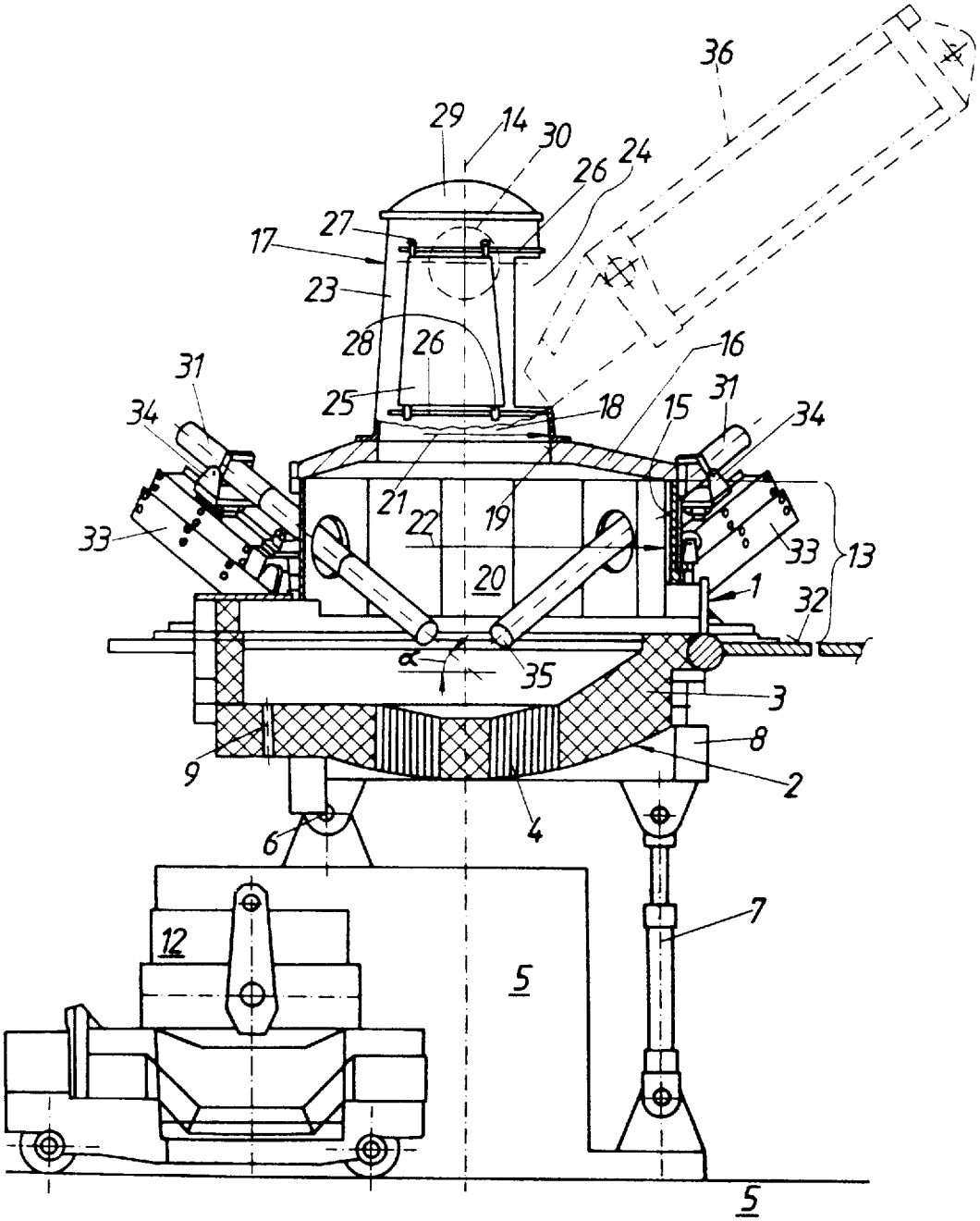
FIGS. 1 and 2 illustrate a vertical meridional section of one embodiment of an electric arc furnace each.

In accordance with the embodiment illustrated in FIG. 1, a furnace vessel 1 of an electric arc furnace is provided with a bottom part 2, which shows a trough-shaped depression and is lined with a refractory material 3 and further includes a bottom anode 4. The bottom part 2 is tiltable supported at the foundation 5 by means of a tilting axle 6; the tilting is effected by means of a pressure medium cylinder 7 hinged to the foundation 5 at one end and to a supporting structure 8 of the bottom part 2 at the other end. Below an oriel-shaped tap 9 of the bottom part 2, a vessel 12 may be positioned for receiving the melt 10 or the slag 11, respectively. At the bottom part 2, an upper part 13 is attached which projects upward from the former and has a side wall 15 that is oriented approximately parallel to the vertical center line 14 of the electric arc furnace. The side wall 15 may be formed by a water-cooled or refractorily-lined metal shell.

The upper part 13 of the electric arc furnace is closed by a suitably water-cooled lid 16 which is removable preferably by swiveling but also by being lifted off. A charging shaft 17 is arranged centrally on top of the lid 16, such that the charging shaft interior 18 communicates with the furnace interior 20 via an opening 19 provided at the lid 16. The electric arc furnace being in an upright position, the vertical center line 14 of the electric arc furnace is identical with the longitudinal center line of the charging shaft 17. The largest diameter 21 of the charging shaft interior 18, which exhibits a slightly flare-shaped enlargement toward the bottom, is considerably smaller than the diameter 22 of the upper part 13 of the electric arc furnace; preferably, it is approximately half the diameter 22 or less.

The charging shaft 17 is provided with a charging opening 24 which is arranged in its side wall 23 and is closeable by means of a charging door 25. According to the exemplary embodiment illustrated in FIG. 1, the charging door 25 is displaceable along the outside of the charging shalt 17, in the peripheral direction. This is accomplished by means of guide bars 26 which are arranged on the outside of the charging shaft and which serve for guiding the charging door 25 by means of rollers 27 or holding devices 28, respectively.

The charging shaft 17 is closed by means of a removable lid 29, such that the interior 18 of the, charging shaft 17 is easily accessible for carrying out maintenance work, etc. At the upper end of the charging shaft, an offgas duct 30 is attached.

Through the vertical side wall 15 of the upper part 13 of the electric arc furnace, electrodes 31 are arranged approximately radially symmetrical and project obliquely downward into the furnace interior 20. They are directed roughly toward the center, i.e. toward the vertical center line 14 of the electric arc furnace. The electrodes 31 are carried by electrode supporting devices 33 supported at the top platform 32. These electrode supporting devices 33 are tiltable about a horizontal axis, whereby the electrode angle $\alpha$ relative to the horizontal line may be adjusted to the desired measure. Further, the electrodes 31 are capable of displacement in their longitudinal direction by means of the electrode supporting device 33, namely by means of electrode joinings 34 capable of being displaced at the electrode supporting device. The electrode supporting devices 33 suitably are also tiltable about a vertical axis, so that it becomes feasible for the tips of the electrodes 35 to sweep over a certain area in the furnace interior 20, as can be seen particularly from FIG. 5, by the double arrows.

In the particular embodiment of an electric arc furnace illustrated in FIG. 1, the charging shaft 17 is rigidly connected with the lid 16, wherein the charging shaft 17 can be easily dismantled to enable repair activities, to exchange parts, etc. In this case, the charging shaft is tilted along with the furnace vessel during tapping.

This embodiment is suitable whenever there is no need for extremely high production capacities. The charging shaft is just high enough to accommodate a lateral charging opening 24 which is closeable by means of a slidable or displaceable charging door 25. The scrap is charged to the furnace vessel 1 through this charging opening 24, with the scrap forming a pile in the shape of a truncated cone in the furnace vessel 1, thus enabling the application of the oblique electrode principle. In this case the scrap does not extend into the charging shaft.

Figure 2:
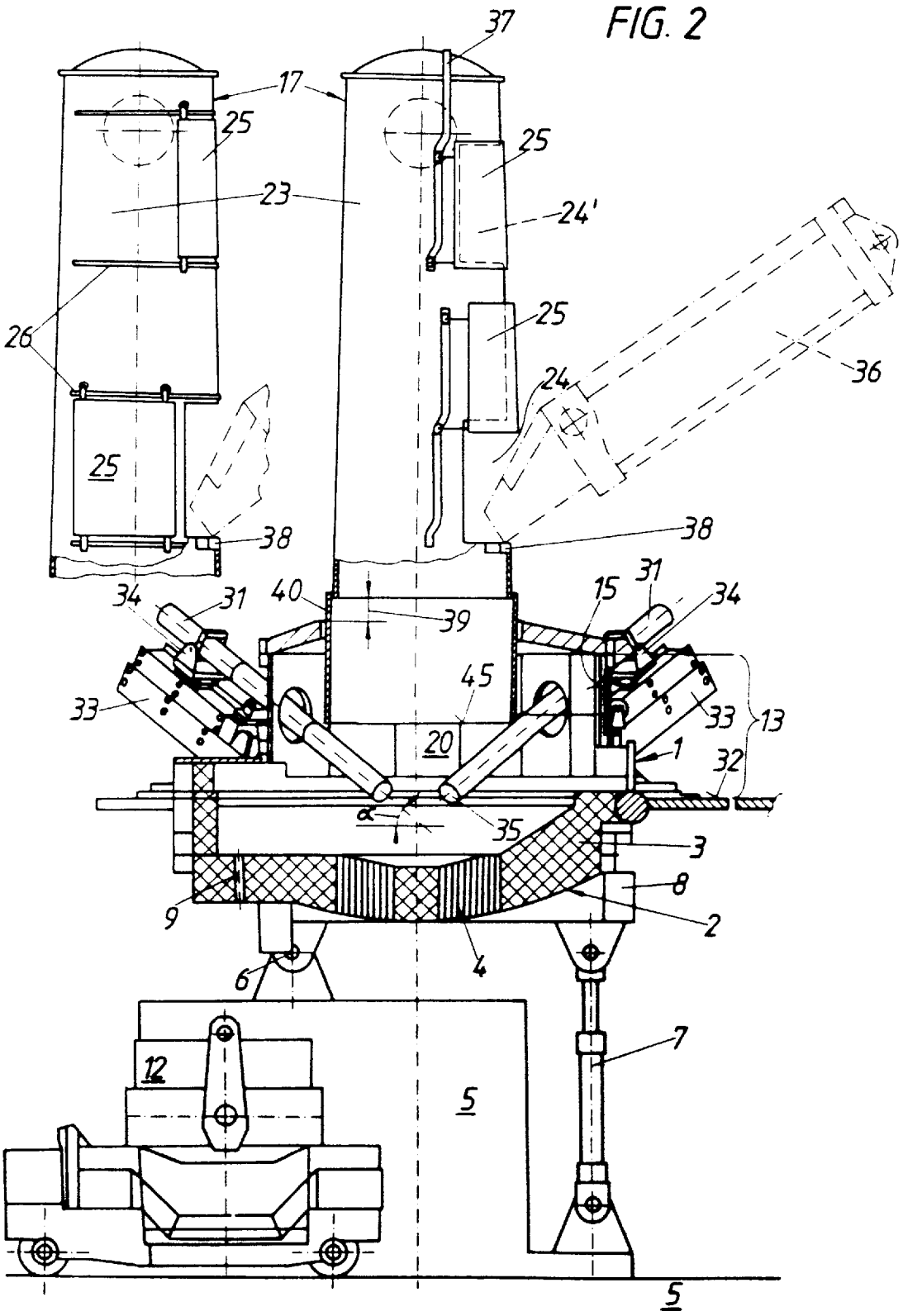
Figure 6:
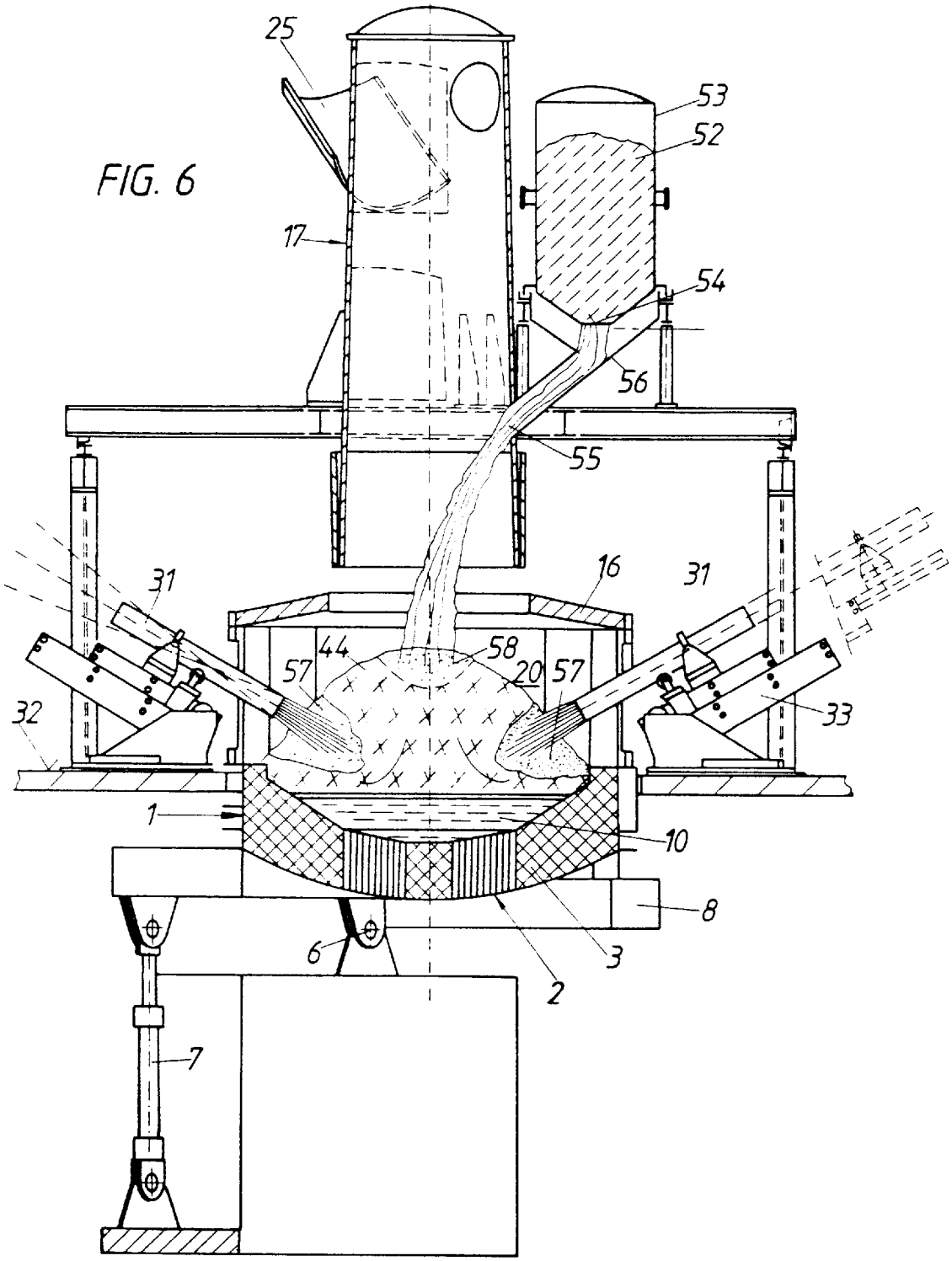
FIG. 6 depicts a different embodiment, also in vertical section.

In accordance with the embodiment illustrated in FIG. 2 the charging shaft 17 is markedly higher and is provided with one or, as depicted in FIG. 2, with two charging openings 24, 24' disposed one above the other and both of which, again, are closeable by means of one charging door 25 each. The charging doors 25 may be arranged at the charging shaft 17 in such a way as to be capable of being displaced both laterally and in the vertical direction; alternatively, the charging doors 25, as illustrated in FIG. 6, may also be arranged at the charging shaft 17 in such a way as to be slewable about a horizontal or a vertical axis.

One advantage offered by the vertical movability of the charging doors 25 is that by slowly displacing the charging door 25 in the upward direction the charging opening 24 needs to be opened only far enough to match the current angle of inclination of a scrap chute 36 delivering the scrap. The inner width of the charging opening 24, 24' may here be kept to a minimum. Here, the guide rails 37 or guide bars 26 respectively, along which the charging doors 25 are movable, are constructed such that the charging doors 25 can be easily lifted off the side wall 23 of the charging shaft 17 in the radial direction when being opened and when being closed sit as close to the side wall 23 as possible.

In accordance with the embodiment illustrated in FIG. 2, the lower edge of the charging opening 24 is formed by a thick-walled water-cooled beam 38, on which the scrap chute 36 can be placed without damaging the side wall 23 of the charging shaft 17. Racks with gear motors, cable drums or hydraulic cylinders may be employed as the gear for the charging doors 25.

Figure 9:
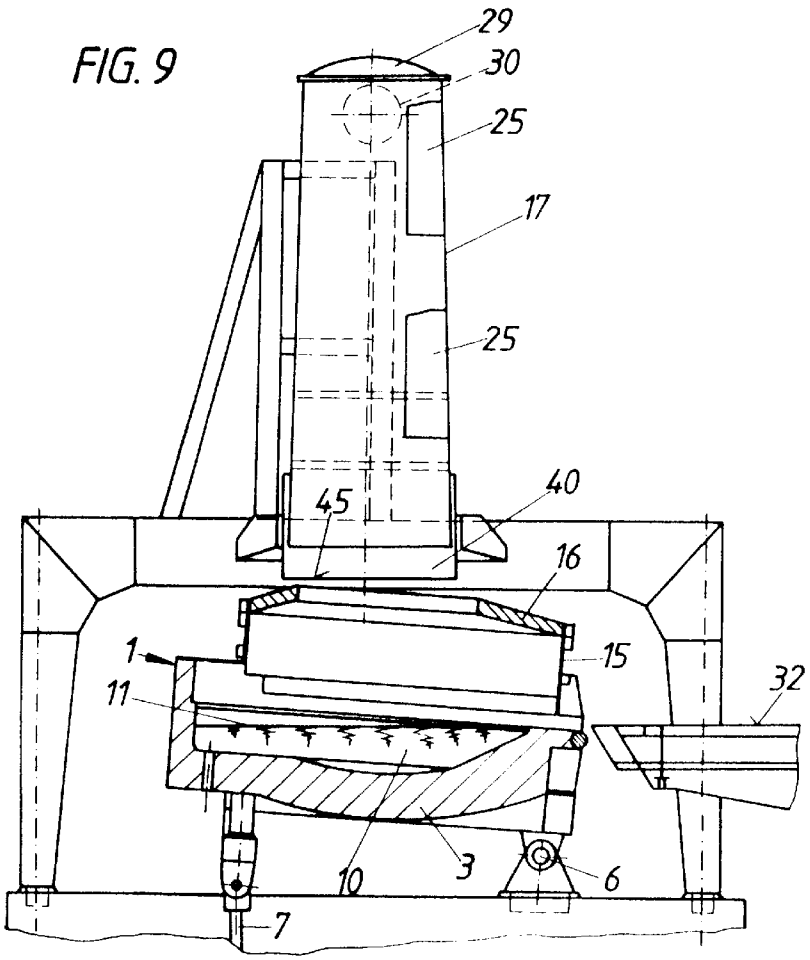

The lower end of the charging shaft 17 is located at the distance 39 above the lid 16 of the electric arc furnace. The free space which thus becomes available between the lid 16 and the charging shaft 17 is bridged over by means of a sliding sleeve 40 surrounding the charging shaft 17. From a lowermost position, illustrated in FIG. 2, the sliding sleeve 40 can be moved to an uppermost position, depicted for example in FIG. 9. Consequently, the electric arc furnace can be tilted separately from charging shaft 17, as illustrated in FIG. 9.

Figures 3, 13:
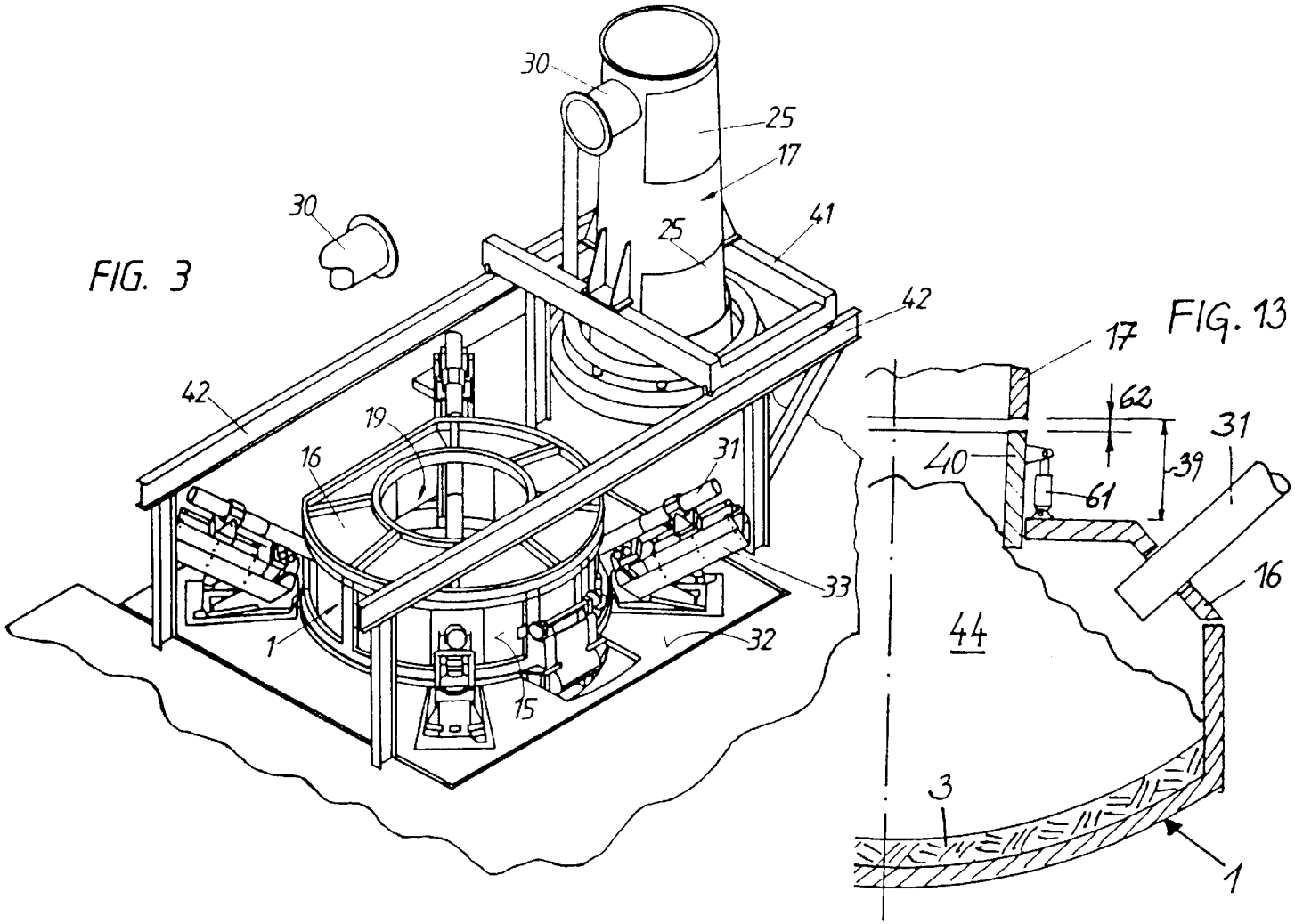
FIG. 3 shows a diagonal view of the electric arc furnace illustrated in FIG. 2, but with a laterally displaced charging shaft.
FIGS. 12 and 13 depict further embodiments in diagrammatic section.

As can be seen from FIG. 3 in particular, the charging shaft 17 advantageously is capable of lateral displacement relative to the furnace vessel 1, for which purpose it is mounted on a supporting structure 41 which is capable of displacement along the tracks 42 arranged beside the electric arc furnace and above the same. In this case, the charging shaft 17 remains in the vertical position. The free space (gap) between the charging shaft 17 and the tiltable furnace vessel 1 which is necessary for displacing the charging shaft 17 and for tilting the furnace vessel may also be obtained by lifting the charging shaft 17.

By laterally displacing the charging shaft 17, the furnace interior 20 of the electric arc furnace is rendered easily accessible and it becomes feasible f.i., to charge very big pieces of scrap directly to the furnace interior 20. Furthermore, as soon as the charging shaft 17 has been laterally displaced, repair and maintenance activities can be carried out in an easy manner in the furnace interior 20, for example at the brick lining of the furnace or at the bottom anode 4, as well as a the laterally displaced charging shaft 17 and at the sliding sleeve 40.

The sliding sleeve 40 is suitably designed as a water-cooled "pipe-next-to pipe"-construction and is made of thick-walled heat-proof pipes. Here, the coiled pipes advantageously are vertically arranged, to enable an easy descent of the charged scrap.

The sliding sleeve 40 may also be constructed as a water-cooled box-like structure, with the inner sheet casing of the sliding sleeve 40 consisting of thick-walled heatproof sheet metal in order to withstand the abrasion caused by the scrap. Here, the water-carrying ribs are advantageously disposed internally, in the horizontal direction, whereby the section modulus is increased and an enhanced dimensional stability of the sliding se eve 40 can be achieved. The coolant streams through from the bottom toward the top, i.e. the lower part, which is exposed to higher temperatures, first comes into contact with the as yet cooler coolant; the heated coolant rises upward.

The sliding sleeve 40 may be constructed as a one-piece closed cylinder jacket or it may consist of two or more parts which are joined together to form a cylinder jacket.

The vertical displacement of a sliding sleeve 40 is actuated by three or several hydraulic cylinders or cable drums, the drive units being disposed at a sufficiently large distance—protected from an unacceptable thermal load—at the supporting structure 41 of the charging shaft 17. Chains or rods may serve as a link between the drive units and the sliding sleeve 40.

Figure 8:
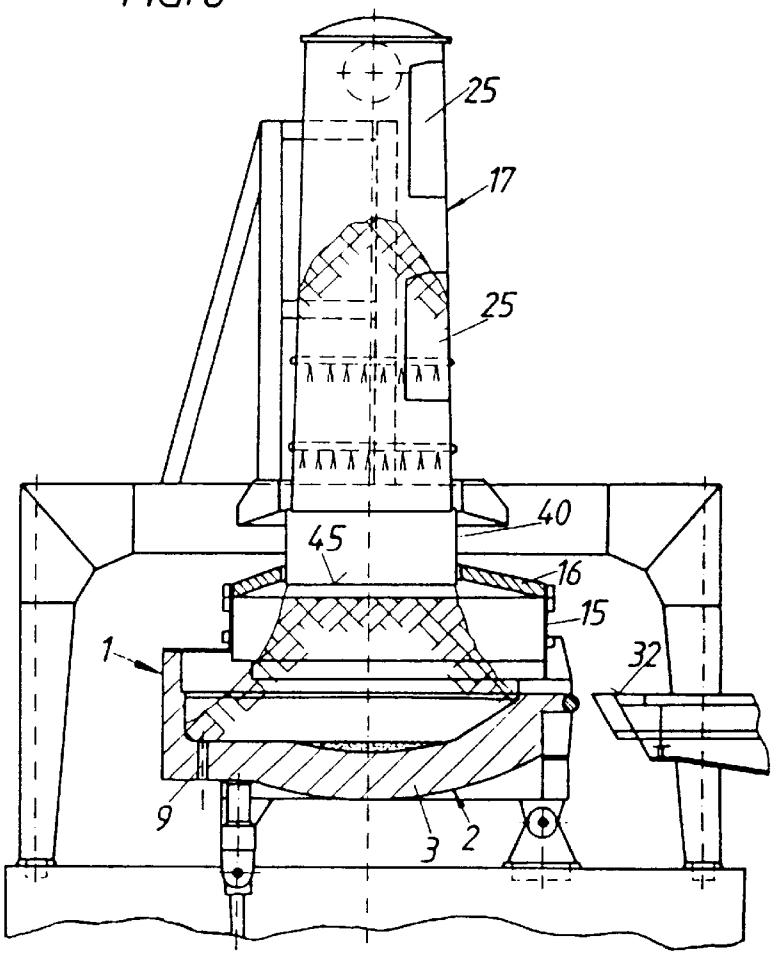
FIGS. 7 to 9 explain the function of a sliding sleeve of an electric arc furnace constructed in a manner similar to that illustrated in FIG. 2, but including an afterburning means.
Figure 7:
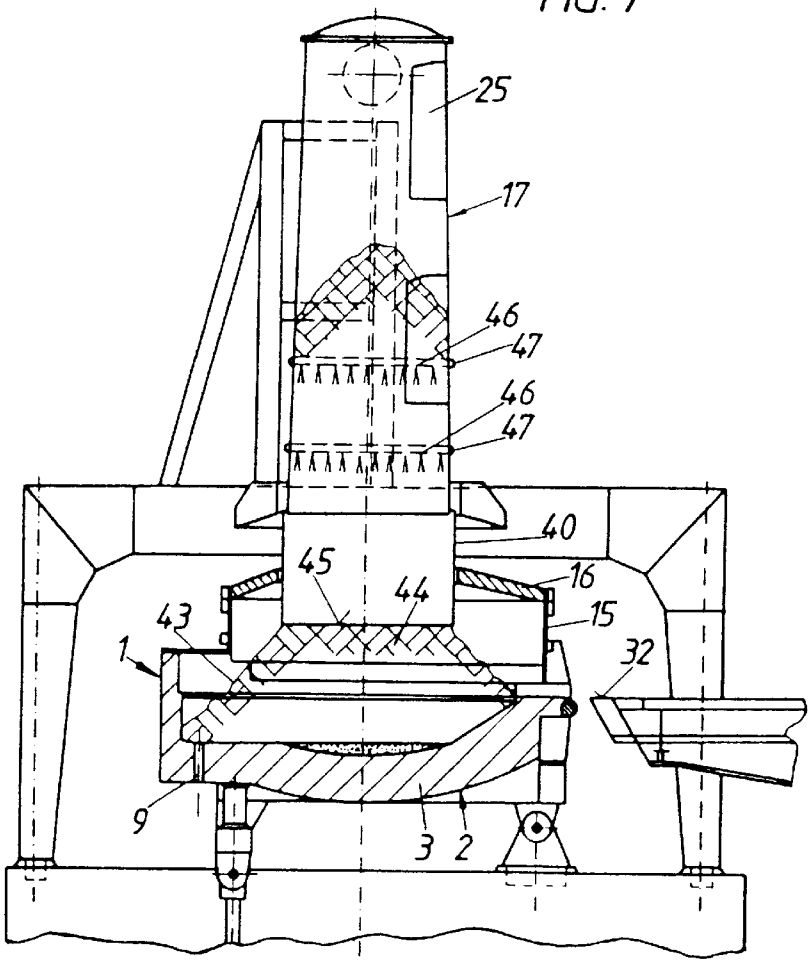

The function of the sliding sleeve is evident from FIGS. 7 to 9, in which—for the sake of clarity—the electrodes 31 have been left out:

According to FIG. 7 the sliding sleeve 40 is moved to the lowest position, where it projects into the furnace interior 20. Thus it ensures a certain outline 43 of the scrap column 44 running out of the charging shaft 17, the base of the scrap column 44, which spreads out conically at the bottom, being limited in diameter.

As soon as the scrap has piled up on the bottom part 2 of the electric arc furnace, the sliding sleeve is pulled upward until it reaches a position where the lower edge 45 of the sliding sleeve 40 is on a level with the lid 16 of the furnace vessel 1. Some of the scrap previously encompassed by the sliding sleeve 40 now runs out, without, however, enlarging the bottom diameter of the scrap column 44. This is illustrated in FIG. 8.

As long as the charging shaft 17 is filled with scrap, i.e. as long as the scrap column 44, which has piled up on the bottom part of the electric arc furnace, extends into the interior 18 of the charging shaft 17, the charging shaft 17 is fixed to and interlocked with the electric arc furnace in such a way that neither the charging shaft 17 nor the furnace vessel 1 are movable relative to each other.

The sliding sleeve 40 may not only be pulled upward in order to release the furnace vessel 1 for tilting in order to carry out deslagging and tapping but also in order to obtain false air between the lower end of the charging shaft 17 and the opening 19 of the lid 16 for afterburning CO forming during the melting process. As can be seen from FIGS. 7 to 9, a plurality of nozzles 46 is provided at the charging shaft 17 for supplying an oxygen-containing gas for the purpose of afterburning the CO. These nozzles 46 penetrate the side wall 23 of the charging shaft 17 and are disposed so as to form a ring 47 or several rings 47 peripherally surrounding the side wall 23 of the charging shaft 17. Preferably, compressed air is supplied as the oxygen-containing gas.

As a consequence, the feeding of oxygen and hence the afterburning are effected very constantly over the cross-section of the interior 18 of the charging shaft 17 and the formation of so-called afterburning channels is to a large extent avoided or altogether prevented. Excessive oxidizing of scrap can also be avoided.

Figure 10:
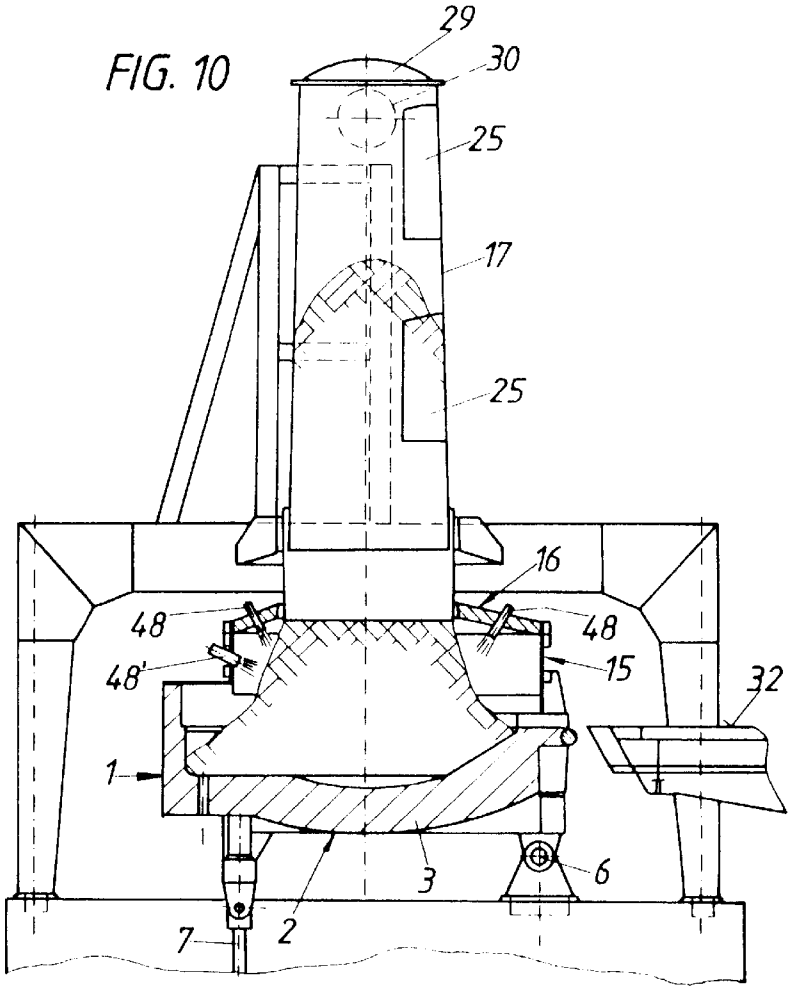
FIG. 10 shows an embodiment of an electric arc furnace which is also provided with an afterburning means, in vertical section.
Figure 11:
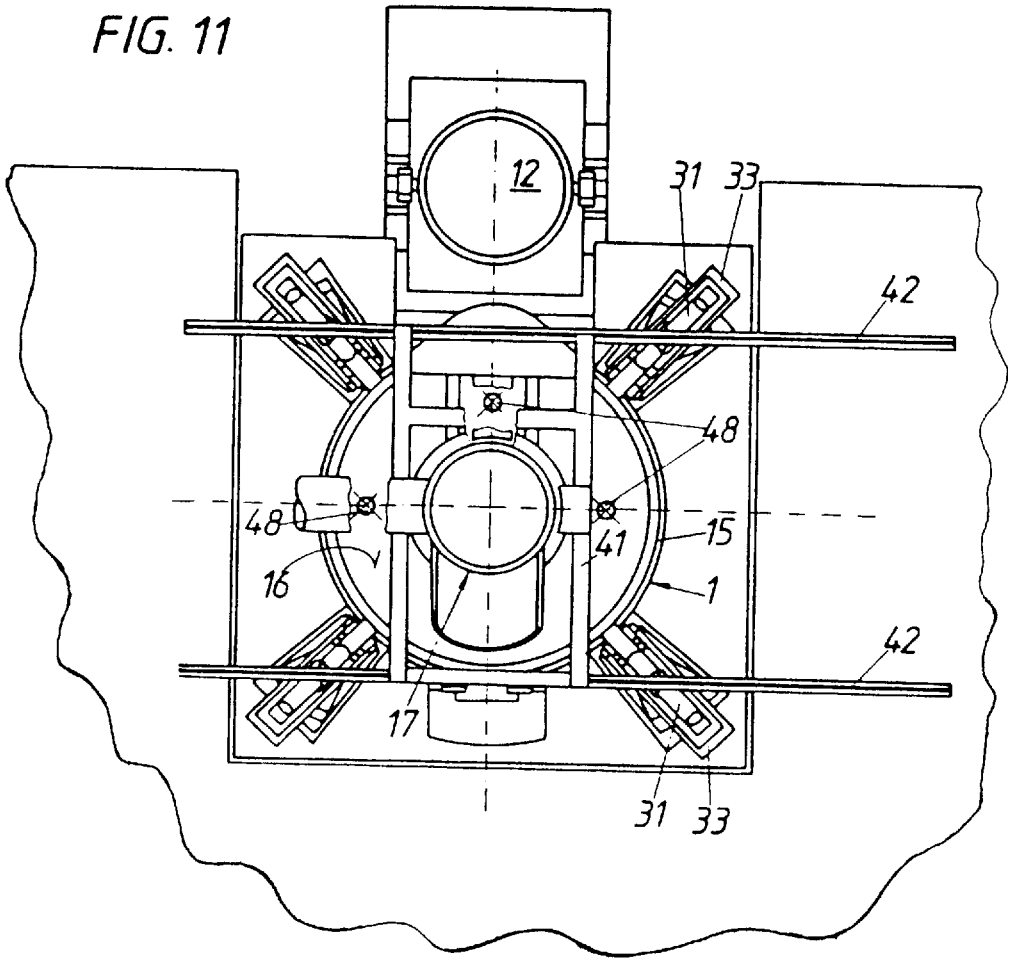
FIG. 11 supplies the matching ground plan.

In accordance with the embodiment illustrated in FIGS. 10 and 11, three afterburning lances 48 or 48' respectively are arranged at the lid 2 or piercing the side wall 15 respectively, which conduct an oxygen-containing gas into the furnace interior 20, so that here, too, afterburning of the combustible gases (which consist mainly of CO) forming during the melting and refining process takes place. The hot, afterburned gases are sucked upward via the scrap column 44 toward the exhauster duct 30, which is connected to the charging shaft 17, and effect the preheating of the scrap column 44.

As can be seen from FIGS. 4 and 5, the charging of the charging shaft 17 may also be effected in a continuous manner, for example by means of a continually operated conveying belt 49. Suitably, a vibroconveying means 50 or a sufficiently inclined sliding surface is provided between the charging opening 24 of the charging shaft 17 and the end of the charging-conveying belt 49.

The charging of hot sponge iron 52 or of briquettes consisting of sponge iron 52 respectively is effected by means of a pear-shaped transport vessel 53, which is charged with the sponge iron 52 from the direct reduction plant After the sponge iron 52 has been poured into this transport vessel 53 it is flooded with nitrogen, is closed at the orifice 54 and transported to the electric arc furnace disclosed in the invention, where it is tilted by 180°, so that the closed orifice 54 arrives at the bottom. The charging shaft 17 has an opening 55 disposed in its side wall for charging the sponge iron 52, from which a delivery chute 56 projects obliquely upwards. After the pear-shaped transport vessel 53 has been mounted on top of this delivery chute 56, which is supported at the supporting structure 41 of the charging shaft 17, the orifice 54 of the transport vessel 53 is opened and the sponge iron 52 can enter the furnace interior 20 via the delivery chute 56, by the aid of gravity, as shown in FIG. 6.

By the electric arcs, of which four are provided according to the illustrated embodiment, four caverns or cavities 57 are burned into the scrap pile 44. The hot melting gases are first pressed downward and then rise upward substantially in the center of the scrap pile 44, thereby causing a central cavern or cavity 58 to form at the upper end of the scrap pile 44. The sponge iron 52 is charged into the central cavern or cavity 58 of the scrap pile 44 or, later, onto the melt 10 continuously. This operation is repeated until the desired amount of sponge iron 52 or sponge iron briquettes respectively has been charged.

Figure 12:
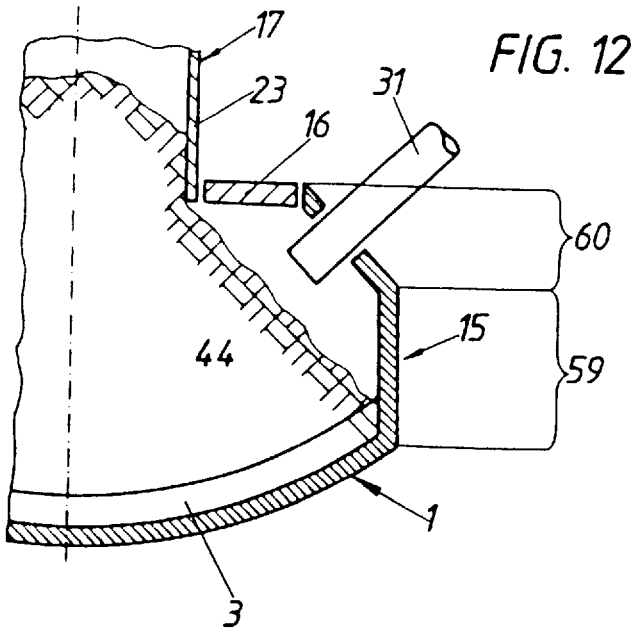

In accordance with the embodiment illustrated in FIG. 12, only the lower portion 59 of the side wall 15 of the furnace vessel 1 is oriented vertically, whereas the upper portion 60 is upwardly tapered towards the lid 16. Thereby it becomes feasible to provide the electrodes 31 at a higher level of the furnace vessel 1 but still in the side wall 15, such that the tips of the electrodes are well protected from the descending scrap.

As can be seen from FIG. 13, a well-protected arrangement of the electrodes 31 can also be achieved by positioning them in such a way that they penetrate a portion of the lid 16 of the furnace vessel 1 which is outwardly flared toward the bottom. With this construction, the interior of the furnace vessel 1 is rendered particularly easily accessible by the lid 16 being capable of lateral displacement along with the charging shaft 17. For this purpose, the lid 16 is adapted to be connectable with the charging shaft 17, for instance, via the supporting structure 41 of the latter, so as to form a unit. Preferably, the lid is arranged at the charging shaft 17 or at the supporting structure 41 of the same so as to be liftable by means of a hydraulic lifting mechanism.

The sliding sleeve 40 is disposed at the lid 16 as according to FIG. 13 and is adjustable horizontally by means of the adjusting devices 61, which are constructed as pressure medium cylinders engaging at the lid 16 on the one hand and at the sliding sleeve 40 on the other hand. The sliding sleeve 40 has a diameter that is roughly as large as or larger than that of the lower end of the charging shaft 17 and is liftable and lowerable by the measure 62 (FIG. 12 illustrates the lowered position of the sliding sleeve 40). This measure 62 is dimensioned exactly to safeguard the free tiltability of the furnace vessel 1 without moving the charging shaft 17 from its position; a measure of roughly 50 mm will be sufficient; but up to 200 mm are feasible. Consequently, the sliding that lengthens the side wall 23 of the charging shaft 17.

We claim:

1. A scrap-melting electric arc furnace, for the melting of ferrous scrap as well as sponge iron for producing steel, the electric arc furnace having an interior, the electric arc furnace comprising:

a bottom part for receiving a melt;

an upper part rising up from the bottom part and having a diameter and a side wall oriented so as to be, at least in part, essentially parallel to a vertical center line of the electric furnace;

a lid which covers the upper part;

a charging shaft disposed centrically relative to the upper part and having a charging shaft interior and a diameter which is substantially smaller than the diameter of the upper part, the charging shaft being displaceable laterally; wherein the charging shaft interior communicates with the furnace interior via an opening provided at the lid; and radially symmetrically arranged electrodes are directed obliquely into the furnace interior and project towards the center of the electric arc furnace.

2. An electric arc furnace according to claim 1, wherein the electrodes are tiltable about a horizontal axis by means of electrode supporting devices.

3. An electric arc furnace according to claim 2, wherein the electrodes are tiltable relative to the horizontal line over a range between 10° and 60°.

4. An electric arc furnace according to claim 2, wherein the electrodes are supported by an electrode supporting device and displaceable along their longitudinal axes.

5. An electric arc furnace according to claim 2, wherein each of the electrodes is supported by an electrode supporting device and pivotable about a vertical axis.

6. An electric arc furnace according to claim 1, wherein the charging shaft is rigidly connected with the lid of the electric arc furnace.

7. An electric arc furnace according to claim 1, wherein the charging shaft is movable relative to the lid.

8. An electric arc furnace according to claim 7, wherein the charging shaft is laterally displaceable relative to the lid, in a direction perpendicular to a longitudinal center line of the charging shaft or the vertical center line of the electric arc furnace, respectively.

9. An electric arc furnace according to claim 8, wherein, between the lower end of the charging shaft and the opening provided at the lid of the electric arc furnace, a sliding sleeve is provide which is displaceable along the longitudinal center line of the charging shaft or the vertical center line of the electric arc furnace, respectively.

10. An electric arc furnace according to claim 9, wherein the lower end of the charging shaft is arranged at a distance above the lid of the electric arc furnace, and the free space resulting between the lid and the charging shaft is bridgeable by the sliding sleeve.

11. An electric arc furnace according to claim 10, wherein the length of the sliding sleeve in the direction of the longitudinal center line of the charging shaft exceeds the height of the free space between the lid and the charging shaft.

12. An electric arc furnace according to claim 9, wherein the sliding sleeve is water-cooled and surrounds the charging shaft peripherally at its outside and is conducted along the outside of the charging shaft.

13. An electric arc furnace according to claim 3, wherein the electrodes are tiltable relative to the horizontal line over a range between 30° and 60°.

14. An electric arc furnace according to claim 1, wherein the charging door is displaceable horizontally or vertically between a closed position and an open position.

15. An electric arc furnace according to claim 1, wherein the charging door is water-cooled.

16. An electric arc furnace according to claim 1, wherein the charging opening at its lower edge is provided with a water-cooled rest for a charging device.

17. An electric arc furnace according to claim 1, wherein a conveying device extends from the charging opening.

18. An electric arc furnace according to claim 1, wherein the charging shaft is provided with a charging opening which pierces its side wall and is closeable by means of a charging door.

19. An electric arc furnace according to claim 18, wherein, in one side wall of the charging shaft, one further charging opening is provided that communicates with a delivery chute.

20. An electric arc furnace according to claim 18, wherein the charging shaft is provided with two charging openings disposed one above the other, each of which may be closed by means of a charging door.

21. An electric arc furnace according to claim 1, wherein the charging shaft, at its upper end, is connectable to an offgas duct.

22. An electric arc furnace according to claim 1, wherein the side wall of the charging shaft is provided with several nozzles for feeding an oxygen-containing gas.

23. An electric arc furnace according to claim 22, wherein a plurality of nozzles penetrate the side wall of the charging shaft, the nozzles being arranged in the shape of a ring peripherally surrounding the side wall.

24. An electric arc furnace according to claim 1, wherein at least one lance supplying an oxygen-containing gas penetrates the side wall or the lid of the furnace vessel.

25. An electric arc furnace according to claim 1, wherein the electrodes project through the side wall of the upper part.

26. An electric arc furnace according to claim 1, wherein an upwardly tapering wall section is provided between the charging shaft and the portion of the side wall of the electric arc furnace that is oriented substantially parallel to the vertical center line of the electric arc furnace, and that the electrodes project into the furnace interior through openings provided in the upwardly tapering wall section.

27. An electric arc furnace according to claim 26, wherein the upwardly tapering wall section is combined with the lid of the electric arc furnace.

28. An electric arc furnace according to claim 26, wherein the upwardly tapering wall section is combined with the side wall of the electric arc furnace.

29. An electric arc furnace according to claim 10, wherein the sliding sleeve is arranged at the lid so as to be liftable and lowerable.

30. An electric arc furnace according to claim 29, wherein the sliding sleeve is equal or larger in diameter than the lower end of the charging shaft.

31. An electric arc furnace according to claim 29, wherein the sliding sleeve is arranged at the lid so as to be vertically adjustable by a maximum of 200 mm.

32. An electric arc furnace according to claim 31, wherein the sleeve is vertically adjustable by a maximum of 50 mm.

33. An electric arc furnace according to claim 9, wherein the sliding sleeve is extendable through the opening provided at the lid and into the interior of the furnace.

34. An electric arc furnace according to claim 1, wherein the lid is laterally displaceable together with the charging shaft.

35. An electric arc furnace according to claim 1, wherein the electrodes pass through the lid.

36. An electric arc furnace according to claim 1, wherein the lid is connectable to the charging shaft.

37. An electric arc furnace according to claim 1, wherein the lid is liftable.

38. An electric arc furnace according to claim 37, further comprising a hydraulic lifting mechanism coupled to the lid.

39. An electric arc furnace according to claim 38, wherein the hydraulic lifting mechanism is coupled to the charging shaft.

40. An electric arc furnace according to claim 38, wherein the hydraulic lifting mechanism is disposed on a support structure for the charging shaft.

41. An electric arc furnace according to claim 1, further comprising a sliding sleeve disposed on the lid, the sliding sleeve being adjustable horizontally by means of adjusting devices coupled to the sliding sleeve.

42. An electric arc furnace according to claim 41, wherein the sliding sleeve has a diameter equal to or greater than a diameter of a lower end of the charging shaft.

43. An electric arc furnace according to claim 41, wherein the furnace vessel is tiltable, and the sliding sleeve is liftable and lowerable so as to allow for free tiltability of the furnace vessel.

* * * * *